US006203144B1

(12) United States Patent
Zhang

(10) Patent No.: US 6,203,144 B1
(45) Date of Patent: Mar. 20, 2001

(54) INK JETTING DEVICE HAVING METAL ELECTRODES WITH MINIMAL ELECTRICAL CONNECTIONS

(75) Inventor: Qiming Zhang, Westford, MA (US)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 08/404,086

(22) Filed: Mar. 14, 1995

(30) Foreign Application Priority Data

Apr. 6, 1994 (JP) ..... 6-068284

(51) Int. Cl.[7] ..... B41J 2/045
(52) U.S. Cl. ..... 347/71; 347/69
(58) Field of Search ..... 347/68, 69, 70, 347/71

(56) References Cited

U.S. PATENT DOCUMENTS 4,095,238 * 6/1978 Kattner et al. ..... 347/68
4,879,568 * 11/1989 Bartky et al. ..... 347/68
5,548,313 * 9/1996 Lee ..... 347/68

FOREIGN PATENT DOCUMENTS 53-12138 4/1978 (JP) .
61-59914 12/1986 (JP) .
63-247051 10/1988 (JP) .

* cited by examiner

*Primary Examiner*—N. Le
*Assistant Examiner*—C. Dickens
(74) *Attorney, Agent, or Firm*—Oliff & Berridge, PLC

(57) ABSTRACT

An ink jetting device includes a wall that constitutes at least a part of an ink channel and is formed of piezoelectric ceramic material polarized in one direction. A first electrode is formed wholly over one surface of the wall, a second electrode is formed partially on the other surface of the wall, and a third electrode is formed at a position that is spaced from the second electrode on the other surface of the wall. A controller is connected to the second and third electrodes but is not connected to the first electrode. The controller induces a potential difference between the second and third electrodes to deform the wall with a piezoelectric effect, so that the ink in the ink channel is pressurized to jet an ink droplet from the ink channel.

26 Claims, 5 Drawing Sheets

INK JETTING DEVICE HAVING METAL ELECTRODES WITH MINIMAL ELECTRICAL CONNECTIONS

BACKGROUND OF THE INVENTION

1. Field of the Invention

The present invention relates to an ink jetting device.

2. Description of Related Art

In recent years, non-impact type printing devices have superseded previously used impact type printing devices and have increasingly propagated in the market. Of these non-impact type printing devices, the ink jetting type printing device is more popular because it has the simplest printing principle and facilitates a color printing operation with high gradation. In this type of printing device, a drop-on-demand type printing device, in which only an ink droplet for printing is jetted, has rapidly increased in popularity in the market because of its high ink jetting efficiency and low running cost.

Examples of the drop-on-demand type printer include the Kyser type, as disclosed in Japanese Patent Publication No. 53-12138, and the thermal jet type, as disclosed in Japanese Patent Publication No. 61-59914. However, these types of printing devices have the following critical problems. With respect to the former, it is difficult to design the device with a compact size. With respect to the latter, ink is heated at a high temperature, thus requiring ink with a high heat-proof property.

To solve both of the above problems at the same time, a shear mode type, as disclosed in Japanese Laid-open Patent Publication No. 63-247051, is proposed as a new type of printing device.

FIGS. 3A and 3B show a shear mode type of ink jetting device. As shown in FIG. 3A, the shear mode type of ink jetting device 10 comprises a bottom wall 20, a ceiling wall 22, a rigid wall 26, an actuator wall 60 and an ink channel 24, which is surrounded so as to be sealed and defined by the above walls.

The actuator wall 60 is formed of piezoelectric ceramic material that is polarized in a Z-direction perpendicular to the ceiling wall 22 and the bottom wall 20, and it is firmly fixed to the bottom wall 20 and the ceiling wall 22. The wall surfaces 65 and 66 of the actuator wall 60 are provided with metal electrodes 68 and 69 at the lower side thereof and with metal electrodes 68' and 69' at the upper side thereof so as to be spaced from the metal electrodes 68 and 69. The metal electrodes 68, 68', 69 and 69' are electrically connected to a controller C.

As shown in FIG. 3B, when ink is jetted, the controller C controls the metal electrodes 68' and 69 to be grounded and applies a driving voltage V to the metal electrodes 68 and 69'. Through this operation, electric fields in opposite directions occur at the upper and lower portions of the actuator wall 60. Therefore, the upper and lower portions of the actuator wall 60 are displaced by thickness shear in such directions that the volume of the ink channel 24 is reduced. This deformation of the actuator wall 60 pressurizes the ink in the ink channel 24, so that an ink droplet is jetted from nozzles (not shown in this view) that intercommunicate with the ink channel 24.

In the ink jetting device described above, the metal electrodes 68' and 69 are grounded, and the metal electrodes 68 and 69' are supplied with the driving voltage. Thus, the metal electrodes 68, 68', 69 and 69' must be connected to the controller C. Accordingly, this ink jetting device has a disadvantage that a large number of connections between the controller C and the metal electrodes are required, and thus the manufacturing cost of the device is high.

SUMMARY OF THE INVENTION

An object of the present invention is to provide an ink jetting device that has a small number of connections of metal electrodes to a controller and can be manufactured at low cost.

To attain the above and other objects, an ink jetting device according to the present invention includes a wall that constitutes at least a part of an ink channel and is formed of piezoelectric ceramic material polarized in one direction. A first electrode is formed wholly over one surface of the wall, a second electrode is formed partially on the other surface of the wall, and a third electrode is formed at a position not connected to the second electrode on the other surface of the wall. A controller is connected to the second and third electrodes but is not connected to the first electrode. The controller induces a potential difference between the second and third electrodes to deform the wall with a piezoelectric effect, whereby ink in the ink channel is pressurized and an ink droplet is jetted from the ink channel.

In the ink jetting device of this invention thus constructed, the controller induces the potential difference between the second and third electrodes so that an electric field in a direction perpendicular to the polarization direction of the wall is produced between the first and second electrodes. Simultaneously, an electric field in the opposite direction to the direction of the electric field occurring between the first and second electrodes is produced between the first and third electrodes. The wall is deformed by the piezoelectric effect of the piezoelectric ceramic material, and the ink is pressurized in the ink channel so that the ink droplet is jetted from the ink channel. As noted above, the controller is connected to the second and third electrodes, but it is not connected to the first electrode. Therefore, the electrical contact (connection) between the electrodes and the controller can be performed in a simple manner. Thus, the productivity is excellent, and the manufacturing cost can be reduced.

BRIEF DESCRIPTION OF THE DRAWINGS

A preferred embodiment of the present invention is described in detail with reference to the following figures wherein.

DETAILED DESCRIPTION OF PREFERRED EMBODIMENTS

Figure 1A:
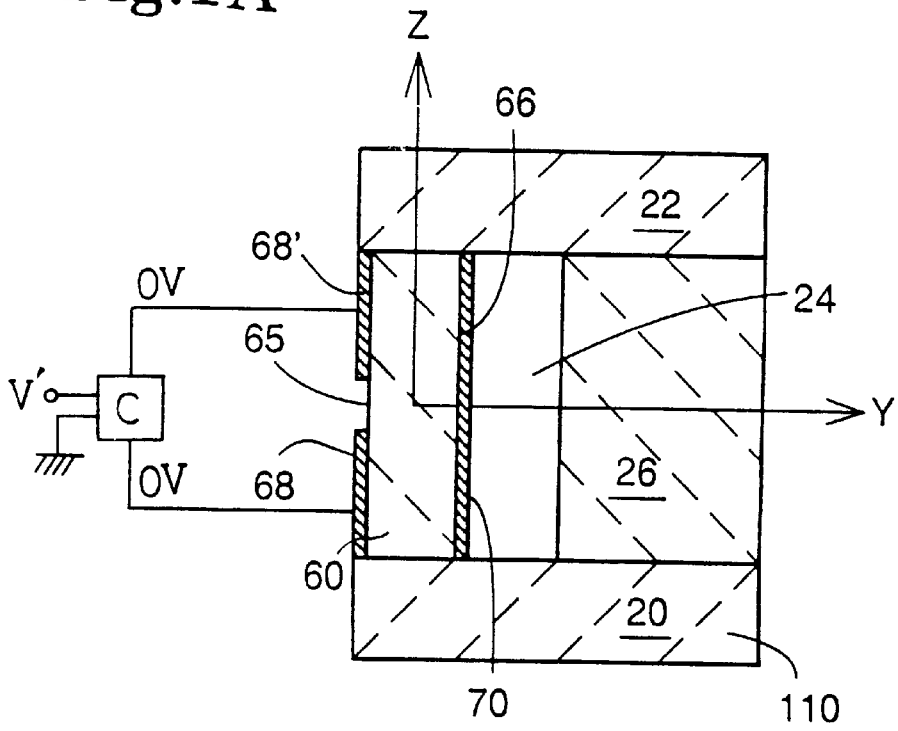
FIG. 1A is a schematic side view in cross section showing the construction of an ink jetting device according to a first embodiment of the present invention.

Preferred embodiments according to the present invention are described with reference to the accompanying drawings. In the following description, the same elements as the conventional ink jetting device as described in the background section above are represented by the same reference numerals, and the description thereof is omitted.

Figure 1B:
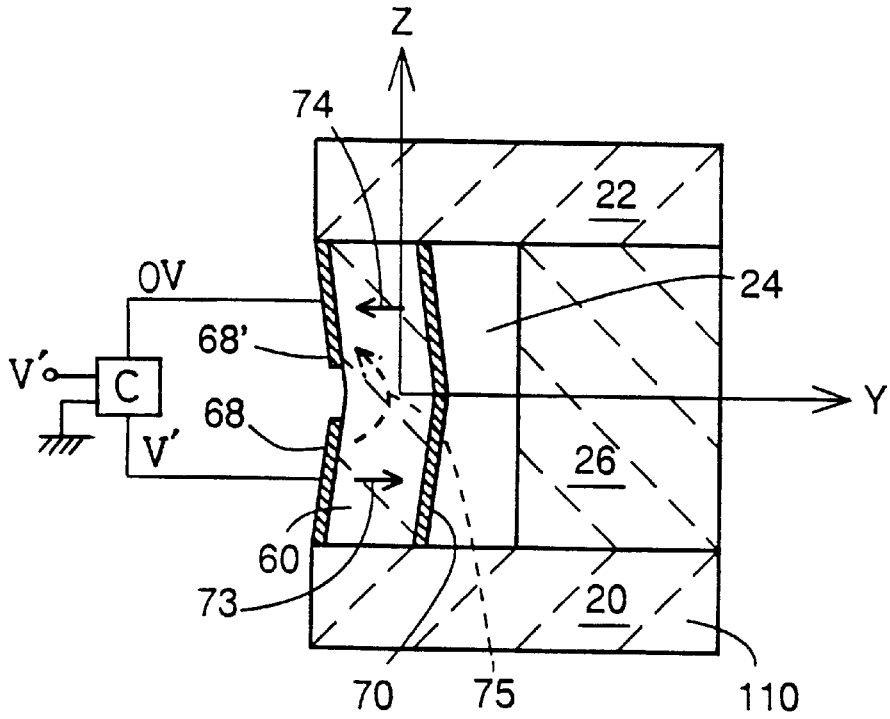
FIG. 1B is a schematic side view in cross section showing the operation of the ink jetting device of FIG. 1A according to a first embodiment of the present invention.
Figure 3A:
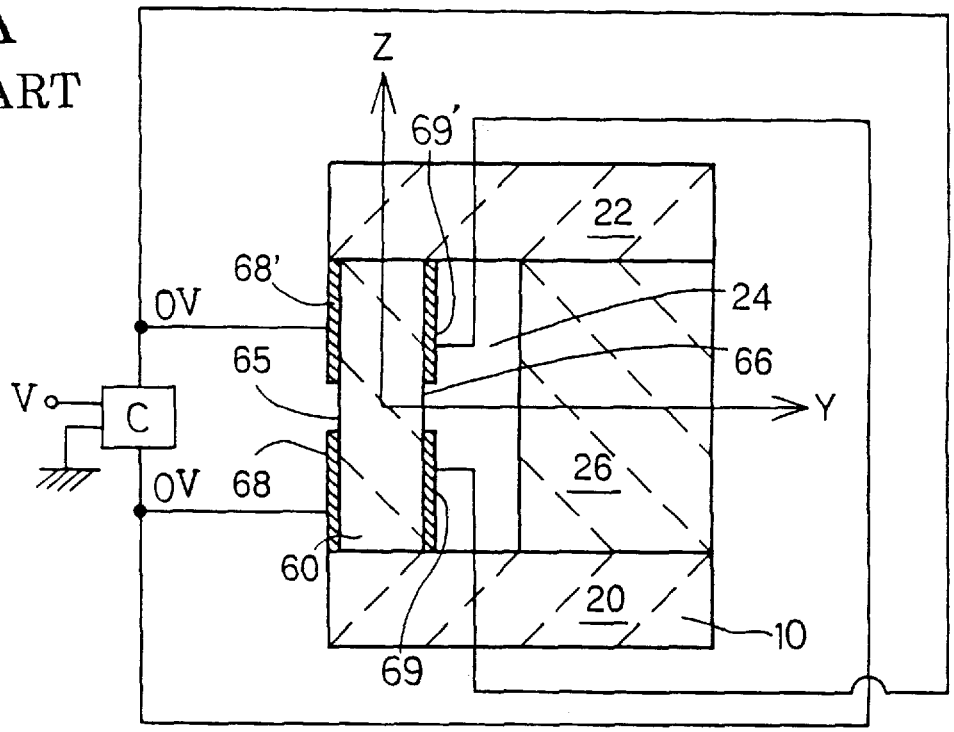
Fig.3 A PRIOR ART
FIG. 3A is a schematic side view in cross section showing the construction of a conventional shear mode type of ink jetting device.

FIGS. 1A and 1B schematically show an ink jetting device of a first embodiment of the invention. Like the conventional ink jetting device shown in FIG. 3A, the ink jetting device 110 of this embodiment basically comprises a rigid wall 26, an actuator wall 60, a bottom wall 20, a ceiling wall 22 and an ink channel 24, which is defined by the above walls. The wall surface 65 of the actuator wall 60 is provided with a metal electrode 68 serving as a second electrode at the lower side thereof and with a metal electrode 68' serving as a third electrode at the upper side thereof spaced from the metal electrode 68. Further, a metal electrode 70 serving as a first electrode is formed on the whole wall surface 66 of the actuator wall 60, which corresponds to an inner surface of the ink channel 24.

The metal electrodes 68 and 68' are connected to a controller C, and the metal electrode 70 is not connected to the controller C. Controller C selectively applies voltage and grounds the electrodes 68 and 68' depending upon the activation of the ink channel. Also, the electrode 68 can be grounded while the electrode 68' has voltage applied thereto if desired.

Next, the operation of the ink jetting device of the first embodiment is described. When an ink droplet is jetted, the controller C grounds the metal electrode 68' formed at the upper portion of the actuator wall 60 and applies a driving voltage V' to the metal electrode 68 formed at the lower portion of the actuator wall 60. Through this operation, an electric field 73 in the Y-direction occurs between the metal electrode 68 and the metal electrode 70 in the actuator wall 60, and an electric field 74 in a direction opposite to the Y-direction occurs between the metal electrode 68' and the metal electrode 70. Further, a leak electric field 75 is directly formed between the metal electrode 68 and the metal electrode 68'. However, since the actuator wall 60 is designed so that the thickness (Y-direction) thereof is extremely small as compared with the height (Z-direction) thereof, the leak electric field 75 is still weaker than the electric field 73 and the electric field 74, which serve to deform the actuator wall 60. Thus, it is negligible. In FIGS. 1A and 1B, the actuator wall 60 is illustrated as being thicker than an actual size for purposes of explanation.

The directions of the electric fields 73 and 74 are opposite to each other and are perpendicular to the Z-direction corresponding to the polarization direction of the actuator wall 60. So, the actuator wall 60 is deformed toward the inside of the ink channel 24 by the thickness shear effect of the piezoelectric ceramic material. Through this deformation, the ink in the ink channel 24 is pressurized, and the ink droplet is jetted from nozzles (not shown) intercommunicating with the ink channel 24.

Figure 3B:
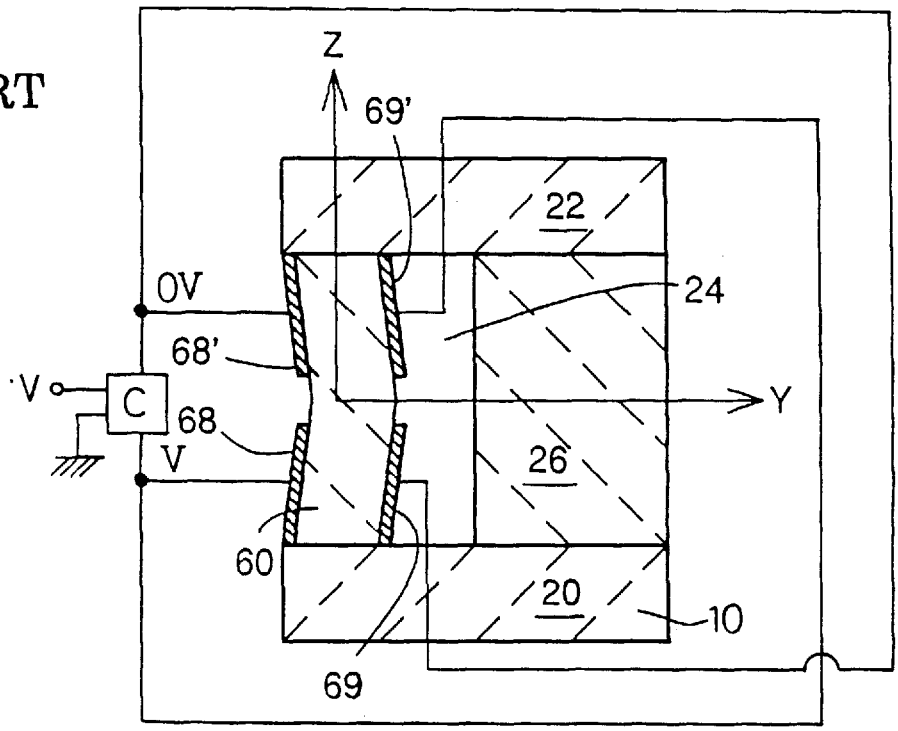
Fig.3B PRIOR ART
FIG. 3B is a schematic side view in cross section showing the operation of the conventional shear mode type of ink jetting device.

Here, the actuator wall 60 basically serves as a capacitor. Thus, the direction of current that flows at the rise-up time and the fall time of the driving voltage V' applied to the metal electrode 68 is coincident with the direction of the electric field 73, 74. Therefore, the current flows from the metal electrode 68 to the metal electrode 70, and further flows through the metal electrode 70 to the metal electrode 68'. Accordingly, the upper and lower portions of the actuator wall 60 are electrically connected to each other in series. As compared with the conventional ink jetting device in which the upper and lower portions are apparently connected in parallel (see FIGS. 3A and 3B), a double driving voltage must be applied to induce the same deformation in the actuator wall 60 in this embodiment. However, as described above, the actuator wall 60 basically serves as a capacitor, and the capacitance of the actuator wall 60 at the in-series connection is a quarter of that at the in-parallel connection. The supplied energy (power) for the supplied driving voltage is proportional to the capacitance of the capacitor and also proportional to the square of the applied voltage. Therefore, the same energy efficiency is obtained in this embodiment and the prior art.

As described above, in the ink jetting device 110 of the first embodiment, the controller C is connected to the metal electrodes 68 and 68', that is, it is connected to two portions only. On the other hand, the controller of the prior art is connected to four portions, totally. Therefore, the number of the connections is reduced to half. Usually, a printing operation is carried out using a printing head in which a plurality of ink channels thus constructed are provided. Thus, the manufacturing cost can be remarkably reduced if the connection number is reduced to half.

In the prior art (see FIGS. 3A and 3B), the metal electrode 69 disposed in the ink channel 24 is grounded, and the metal electrode 69' is supplied with the voltage V. Therefore, an electric field occurs in the ink that is filled in the ink channel 24, so that ink particles are charged by the electric field. The charged ink particles are electrostatically attracted to and impinge against the metal electrodes 69 and 69'. So, the metal electrodes 69 and 69' may deteriorate. In addition, the charged ink particles adhere to the metal electrodes 69 and 69'. Therefore, the metal electrodes 69 and 69' are liable to corrode. So, the lifetime of the ink jetting device and its reliability is reduced.

However, in the first embodiment as described above, the metal electrode 70 provided inside of the ink channel 24 is not directly connected to the controller C, and the ink is never charged if one ink channel is provided. Accordingly, the deterioration and corrosion of the metal electrode 70 are prevented because the ink does not cling to the electrode 70. So, the lifetime of the ink jetting device is longer than the prior art, and its reliability is more improved than the prior art. However, when a printing head having plural ink channels 24 is used, the ink located between the metal electrode 70 of an activated ink channel 24 and the metal electrode 70 of an unactivated ink channel 24 becomes charged because a current is induced between the electrodes of each channel via the ink. However, these metal electrodes are disposed farther away from each other as compared with the prior art because they are disposed on one end of each channel. Therefore, the induced current would have to travel through the ink down one channel and up the other channel to the other electrode. Therefore, as the induced current is very weak, it takes an extremely long time for the ink particles to adhere to the metal electrode 70 in the channel. So, the metal electrode 70 hardly suffers corrosion, and the lifetime of the ink jetting device is much longer than the prior art.

Figure 2A:
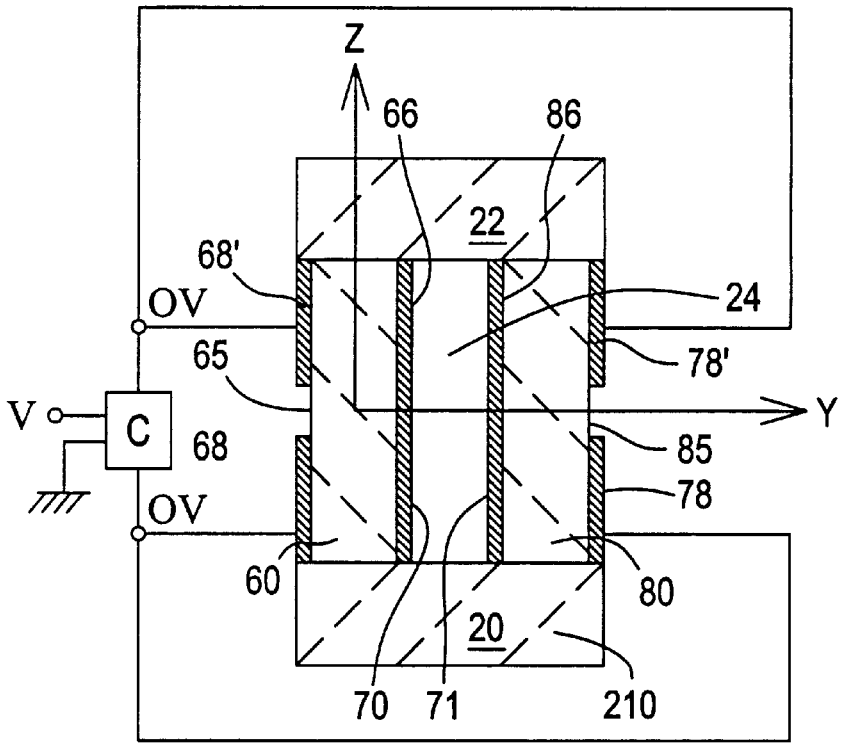
FIG. 2A is a schematic side view in cross section showing the construction of an ink jetting device according to a second embodiment of the present invention.

Next, a second embodiment of the ink jetting device according to the present invention is described with reference to FIGS. 2A and 2B. In an ink jetting device 210 of the second embodiment, an actuator wall 80 is further used in place of the rigid wall 26 of FIGS. 1A and 1B. The actuator wall 80 is formed of piezoelectric ceramic material like the actuator wall 60. The wall surface 85 of the actuator wall 80 is provided with a metal electrode 78 at the lower side thereof and with a metal electrode 78' at the upper side thereof spaced from the metal electrode 78. Further, a metal electrode 71 is formed on the whole wall surface 86 of the actuator wall 80 that corresponds to an inner surface of the ink channel 24. The metal electrodes 78 and 78' are connected to a controller C, and the metal electrode 71 is not connected to the controller C.

Figure 2B:
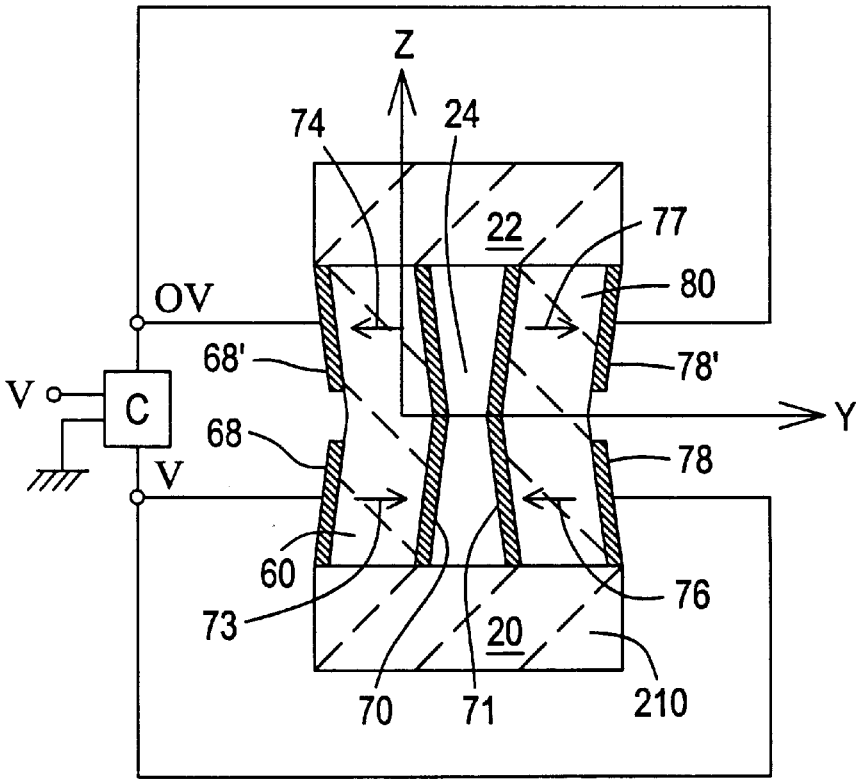
FIG. 2B is a schematic side view in cross section showing the operation of the ink jetting device of FIG. 2A according to a second embodiment of the present invention.

When the controller C connects the metal electrodes 68' and 78' to ground and applies a driving voltage V to the metal electrodes 68 and 78, as shown in FIG. 2B, electric fields 73 and 74 occur in the actuator wall 60 while electric fields 76 and 77 occur in the actuator wall 80. Through this operation, the actuator walls 60 and 80 are deformed so that the volume of the ink channel 24 is reduced to pressurize the ink in the ink channel 24, thereby jetting the ink from nozzles (not shown).

In comparison between the second embodiment for deforming the two walls and the first embodiment for deforming only one wall, in order to obtain the same ink pressure in the ink channel 24, it is sufficient in the second embodiment to supply each wall with a half deformation amount of the first embodiment. Accordingly, the driving voltage of the second embodiment is set to half of the driving voltage V' of the first embodiment. Further, the actuator walls 60 and 80 are deformed in the second embodiment, and thus the capacitance of the capacitor is increased to double of the first embodiment. However, the supply energy for the supplied driving voltage is proportional to the capacitance of the capacitor, and also proportional to the square of the applied voltage. So, the supply energy of the second embodiment is half of that of the first embodiment. Therefore, in the second embodiment the ink droplet can be performed with half the supply energy of the first embodiment. Accordingly, the power consumption can be reduced, and the running cost can be lowered. Further, the driving voltage is small, and thus durability of the actuator wall can be improved.

The same effect could be obtained if the two-wall deforming operation as described above is used in the prior art. However, in this case the number of connections between the metal electrodes and the controller is increased twice as compared with the case where only one wall is driven (deformed). Therefore, the connections become more complicated, and the cost is also increased. On the other hand, the second embodiment can obtain the improved effect as described above with the same connection number in the case where the one-wall deforming operation is used in the prior art.

In the first and second embodiments as described above, only one ink channel 24 is provided. However, a plurality of ink channels may be provided. In this case, an ink droplet may be jetted from those ink channels selected from the plural ink channels.

Further, in the first and second embodiments, the ink in the ink channel 24 is pressurized by reducing the volume of the ink channel 24 from its usual or initial state (i.e., the volume when no voltage is applied) to thereby jet the ink droplet. However, the ink droplet may be jetted in the following manner. That is, driving voltages each having the opposite polarity are applied to the metal electrodes to increase the volume of the ink channel 24 from the usual state. Then, the application of the driving voltages to the metal electrodes is released to return the increased volume of the ink channel 24 to the usual state and pressurize the ink in the ink channel 24 after a predetermined time elapses, thereby jetting the ink from the ink channel 24.

Still further, in the first and second embodiments, the actuator wall 60 and the bottom wall 20 are formed of different members. However, they may be integrally formed by processing one surface of a piezoelectric ceramic plate to form grooves on the surface of the plate. The grooves may be formed on both surfaces of the plate.

Figure 1C:
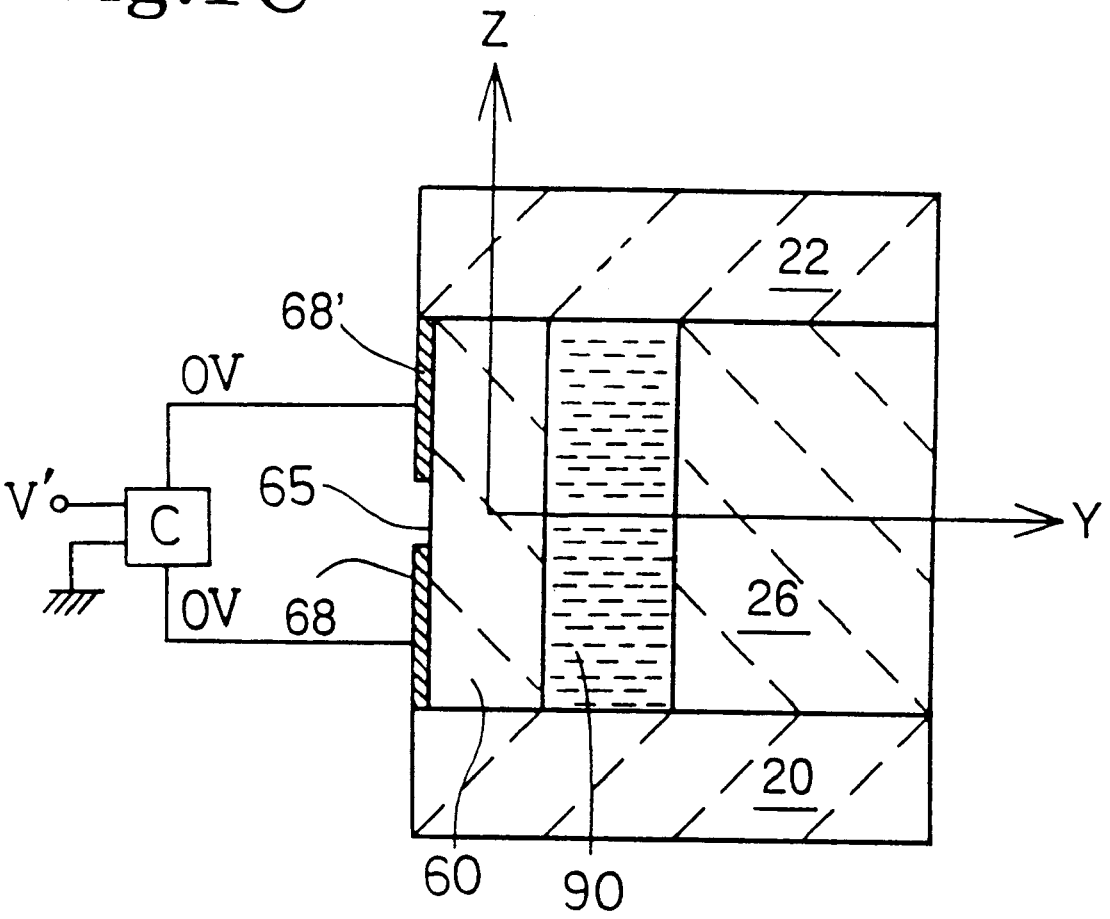
FIG. 1C is a schematic side view in cross section showing a modification of the ink jetting device of FIG. 1A according to the present invention.
Figure 2C:
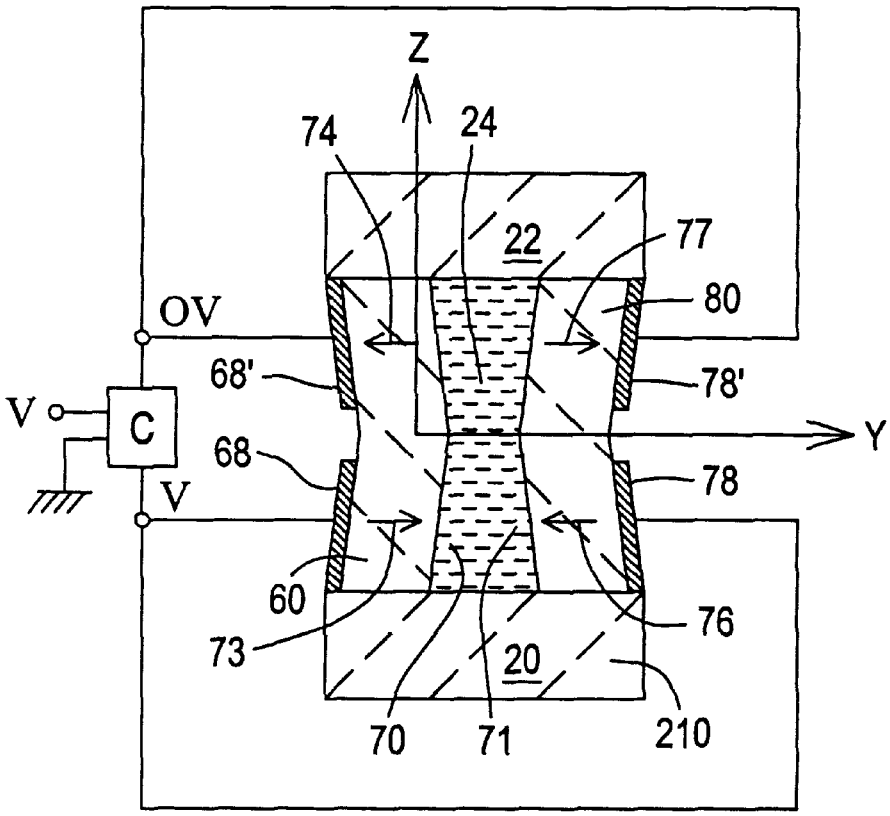
FIG. 2C is a schematic side view in cross-section showing a modification of an ink jetting device according to a second embodiment of the invention.

If the ink has proper conductivity, the metal electrodes 70 and 71 in the ink channel 24 are not necessarily required as shown in FIG. 1C and FIG. 2C. In this case, current flows through the conductive ink 90, and there is no problem if no electrochemical deterioration occurs in the ink.

While advantageous embodiments have been chosen to illustrate the invention, it will be understood by those skilled in the art that various changes and modifications can be made therein without departing from the scope of the invention defined in the appended claims.

What is claimed:

1. An ink jetting device having an ink channel, comprising:

an actuator member formed of piezoelectric ceramic material and defining at least part of the ink channel, the actuator member having a first surface and a second surface that is opposite said first surface, the piezoelectric ceramic material having a polarization direction parallel to the first surface;

a first conductive member in contact with the first surface of the actuator member;

a second conductive member formed partially on the second surface of the actuator member;

a third conductive member formed partially on the second surface of the actuator member and spaced from the second conductive member so as to leave a portion of the second surface free of any conductive member; and a controller electrically connected to the second conductive member and the third conductive member, wherein the controller induces a potential difference between the second conductive member and the third conductive member producing a first electric field through a first portion of said piezoelectric ceramic material polarized in said polarization direction, said first electric field passing between a portion of the first conductive member opposed to the second conductive member and the second conductive member and said first electric field being in a direction perpendicular to said polarization direction and said first electric field produces a second electric field through a second portion of said piezoelectric ceramic material polarized in said polarization direction, said second electric field passing between a portion of the first conductive member opposed to the third conductive member and the third conductive member and said second electric field being in a direction opposite to said first electric field to deform the actuator member with a piezoelectric effect, whereby ink in the ink channel is pressurized and an ink droplet is jetted from the ink channel.

2. The ink jetting device of claim 1, wherein the first conductive member, the second conductive member and the third conductive member are electrodes.

3. The ink jetting device of claim 1, wherein the first conductive member is conductive ink and the second conductive member and the third conductive member are electrodes.

4. The ink jetting device of claim 1, wherein the first surface faces inside the ink channel, and the second surface faces outwardly from the ink channel.

5. The ink jetting device of claim 4, wherein the second surface has an upper corner and a lower corner, and the second conductive member and third conductive member have substantially equal surface area and are disposed at the lower corner and upper corner, respectively, of the actuator member and wherein the first conductive member is formed wholly over the first surface of the actuator member.

6. The ink jetting device of claim 1, wherein the second conductive member and the third conductive member are electrically connected to the controller in series.

7. The ink jetting device of claim 1, wherein the second conductive member and the third conductive member are substantially parallel and extend along a common plane with each other and are substantially parallel and extend along parallel planes with the first conductive member.

8. The ink jetting device of claim 1, wherein the actuator member is a first actuator member, a second actuator member disposed generally parallel to the first actuator member and formed of piezoelectric ceramic material and defining at least part of the ink channel with the first actuator member, the second actuator member having a first surface and a second surface, the first surface of the second actuator member facing the first surface of the first actuator member with the ink channel therebetween, the second actuator member being polarized in a direction parallel to said first surface of the second actuator member, the second actuator member being deformable with a piezoelectric effect, whereby said ink in the ink channel is pressurized and is jetted from the ink channel.

9. The ink jetting device of claim 8, wherein the second actuator member comprises:

a fourth conductive member in contact with the first surface of the second actuator member;

a fifth conductive member formed partially on the second surface of the second actuator member; and a sixth conductive member formed partially on the second surface of the second actuator member and spaced from the fifth conductive member, wherein the controller is electrically connected to the fifth conductive member and sixth conductive member in series and induces a potential difference between the fifth conductive member and sixth conductive member to create the piezoelectric effect.

10. The ink jetting device of claim 9, wherein the fourth conductive member, the fifth conductive member and the six conductive member are electrodes.

11. The ink jetting device of claim 9, wherein the fourth conductive member is conductive ink and the fifth conductive member and the sixth conductive member are electrodes.

12. The ink jetting device of claim 9, wherein the fourth conductive member, the fifth conductive member and the sixth conductive member are provided substantially parallel to the polarization direction of the second actuator member, and wherein the potential difference between the fifth conductive member and the sixth conductive member produces an electric field between the fourth conductive member and the fifth conductive member in a direction perpendicular to the polarization direction of the second actuator member, and produces an electric field between the fourth conductive member and the sixth conductive member in a direction opposite to the direction of the electric field occurring between the fourth conductive member and the fifth conductive member.

13. The ink jetting device of claim 12, wherein the second surface of the second actuator member has an upper corner and a lower corner, and the fifth conductive member and the sixth conductive member have substantially equal surface area and are disposed at the upper corner and the lower corner, respectively, of the second actuator member and wherein the fourth conductive member is formed wholly over the first surface of the second actuator member.

14. The ink jetting device of claim 1, wherein voltage is applied from a voltage source to the second conductive member producing a current flow from the second conductive member to the first conductive member and further producing a current flow from the first conductive member to the third conductive member.

15. The ink jetting device of claim 1, wherein the actuator member comprises a single plate of piezoelectric ceramic material.

16. The ink jetting device of claim 1, wherein the first conductive member has no electrical connections with ground or the controller.

17. A piezoelectric ink jetting device for ejecting ink droplets, comprising:

channel means for defining an ink channel including a deformable wall having two opposed sides and one polarization direction parallel with the deformable wall;

a pair of spaced electrodes being disposed on one side of two opposed sides of the deformable wall and an opposing electrode being disposed on an other side of the two opposed sides of the deformable wall; and electric field inducing means for inducing a first electric field and a second electric field and inducing a potential difference between an upper area and a lower area of the deformable wall to deform the deformable wall, the electric field including means further including power means for supplying voltage to only one of the two opposed sides of the deformable wall, wherein the first electric field is produced between one electrode of said pair of spaced electrodes and the opposing electrode through said upper area of the deformable wall polarized in said one polarization direction, said first electric field being in a direction perpendicular to said one polarization direction and the second electric field is produced between an other electrode of the pair of spaced electrodes and the opposing electrode through said lower area of said deformable wall polarized in said one polarization direction, said second electric field being in a direction opposite to the first electric field.

18. The piezoelectric ink jetting device of claim 17, wherein the power means is electrically connected to one electrode of the pair of spaced electrodes and an other electrode of the pair of spaced electrodes is grounded.

19. The piezoelectric ink jetting device of claim 18, wherein no voltage is applied to the opposing electrode.

20. The piezoelectric ink jetting device of claim 18, wherein the electric field inducing means further comprises conductive ink disposed in the ink channel on the other side of the deformable wall to which no voltage is applied.

21. The piezoelectric ink jetting device of claim 17, wherein the channel means comprises a pair of opposed deformable walls with the ink channel therebetween.

22. The piezoelectric ink jetting device of claim 17, wherein voltage is applied from a voltage source to one electrode of the pair of spaced electrodes producing a current flow from the one electrode of the pair of spaced electrodes to the opposing electrode and further producing a current flow from the opposing electrode to an other electrode of the pair of spaced electrodes.

23. The piezoelectric ink jetting device of claim 17, wherein the channel means comprises a single plate of piezoelectric ceramic material.

24. A method of ejecting ink droplets from an ink jetting device having an ink channel defined therein by a piezoelectric wall having a polarization direction parallel to the piezoelectric wall, comprising the steps of:

providing a first conductive member within the ink channel in contact with the piezoelectric wall;

providing a second conductive member in contact with the piezoelectric wall on an edge of a side outside of the ink channel;

providing a third conductive member in contact with the piezoelectric wall on the edge of a side outside of the ink channel spaced from the second conductive member; and applying voltage only to the second conductive member and grounding the third conductive member to thereby induce a potential difference between the second conductive member and the third conductive member and create opposing first electric field and second electric field in directions perpendicular to the polarization direction of the piezoelectric wall and thereby deforming the piezoelectric wall, the first electric field being formed through a first portion of the piezoelectric wall polarized in said polarization direction, said first electric field passing between the second conductive member and the first conductive member in a first direction and the second electric field being formed through a second portion of the piezoelectric wall polarized in said polarization direction, said second electric field passing between the third conductive member and the first conductive member in a second direction opposite the first direction.

25. The method of claim 24, further comprising the step of applying voltage to the second conductive member producing a current flow from the second conductive member to the first conductive member and further producing a current flow from the first conductive member to the third conductive member.

26. The method of claim 24, further comprising the step of forming the piezoelectric wall from a single plate of piezoelectric ceramic material.

* * * * *